United States Patent [19]

Rose

[11] Patent Number: 4,740,348

[45] Date of Patent: Apr. 26, 1988

[54] METHOD FOR FINISHING CONCRETE

[76] Inventor: Lawrence K. Rose, 4482 Stetson Dr., Prescott, Ariz. 86312

[21] Appl. No.: 944,372

[22] Filed: Dec. 22, 1986

[51] Int. Cl.[4] ..... B28B 11/08; E01C 19/42; E04B 1/16

[52] U.S. Cl. ..... 264/296; 264/31; 264/333; 404/112

[58] Field of Search ..... 264/31, 333, 33, 69, 264/293, 296; 404/112; 425/458

[56] References Cited

U.S. PATENT DOCUMENTS

| | | | |
|---|---|---|---|
| 2,289,248 | 7/1942 | Davis | 264/31 |
| 2,882,805 | 4/1959 | Sieber | 404/112 |
| 2,888,863 | 6/1959 | Eisenbeis | 404/112 |
| 3,130,653 | 4/1964 | Talbott | 404/112 |
| 3,791,754 | 2/1974 | Zochil | 404/112 |
| 4,320,986 | 3/1982 | Morrison | 404/112 |
| 4,629,359 | 12/1986 | Sengupta | 404/112 |

*Primary Examiner*—Jan H. Silbaugh
*Assistant Examiner*—Karen D. Kutach
*Attorney, Agent, or Firm*—Nissle & Leeds

[57] ABSTRACT

An improved method and apparatus for finishing freshly poured concrete. The method includes floating a power trowel on the liquid-particulate surface of freshly poured concrete to produce a smooth, level surface finish prior to the concrete's hardening sufficiently to support the weight of an individual.

3 Claims, 1 Drawing Sheet

METHOD FOR FINISHING CONCRETE

This invention relates to a method and apparatus for finishing freshly poured concrete.

More particularly, the invention relates to a method for finishing freshly poured concrete in which a power trowel floats on the liquid-particulate surface of wet concrete to produce a smooth, level surface finish prior to the concrete's hardening sufficiently to support the weight of an individual.

In another respect, the invention relates to a method for finishing freshly poured concrete in which the labor costs associated with finishing the concrete and the cost of constructing and operating a power trowel utilized in the finishing process are substantially reduced.

In a further respect, the invention relates to a method of the type described for finishing freshly poured concrete in which the rpm of the power trowel blades and the ratio of the weight of the trowel to the surface area of the trowel blades are unusually low.

In still another respect, the invention relates to a method for finishing freshly poured concrete in which the utilization of fresnos is eliminated, in which only a single pass of a power trowel can be utilized to finish the concrete, and in which the position of the power trowel on the concrete is readily controlled with a minimal amount of physical effort by a user.

The conventional process for pouring and finishing concrete is labor intensive and consists of the steps of 1. Pouring fresh concrete.

2. Screeding the concrete to preliminarily level the surface of the concrete.

3. Tamping the concrete to bring the fines to the surface.

4. Moving a bull float over the surface of the wet concrete to "fluff it up" so that the "pores" of the concrete are "open". The bull float is a rectangular piece of material made from pine wood, magnesium or material other than iron or steel. Iron "seals" concrete. Sealing concrete is not desirable during bull floating.

5. Moving a fresno, another rectangular piece of material, over the bull floated concrete. Bull floating leaves lines on the concrete where the ends of the bull float have been drawn over the concrete. The fresno is utilized to produced a smoother, more continuous surface on the concrete. The fresno is fabricated from steel. Use of the fresno begins the process of sealing the concrete.

6. Allowing the concrete to dry an amount sufficient to support the weight of an individual. The dry concrete has a slump of zero inches. As utilized herein, concrete has dried sufficiently to support the weight of an individual when an adult can walk in a normal manner on the concrete without having his or her footsteps form depressions in the surface of the concrete.

7. Utilizing a power trowel to put a smooth slick finish on the surface of the concrete. Conventional power trowels include three or four blades and an engine mounted in a frame. The blades are spaced apart and radially depend from a shaft in the manner that the blades of a fan are spaced apart from one another and radially extends from a rotating shaft. The power trowel blades ride on and smooth the surface of the concrete. A handle is attached to and upwardly extend from the frame in generally the same manner that a handle is attached to and upwardly extends from the frame of a lawn mower. The user grasps the upper end of the handle and pushes the power trowel forward in the same manner that the handle of the lawn mower is utilized to push the lawn mower forward. The user can also use the handle ofthe power trowel to move the trowel from side to side. As earlier noted, concrete must be relatively hard before it will support the weight of a power trowel and support the weight of an individual using the trowel. Conventional power trowels ordinarily weigh at least one hundred and twenty pounds. Since concrete is relatively hard when a power trowel is placed on the concrete, the friction generated between the concrete and the blades of the trowel causes the blades to wear rapidly. In addition, when a user pushes the trowel forward, he also, since the handle of the trowel is sloped, forces the trowel down into the concrete and creates depressions in the surface of the concrete. Three or four passes of a power trowel over the entire surface of a slab of concrete are ordinarily required to properly finish the concrete. Each pass with the power trowel increases the wear on the trowel blades and forms new depressions in the surface of the concrete.

The blades on a conventional power trowel are generally rotated at over one hundred rpm to overcome the frictional forces generated when the trowel blades move over the relatively dry surface of partially hardened concrete.

Accordingly, it would be very desirable to provide an improved method for finishing concrete which would permit concrete to be finished in a substantially shorter period of time, would permit concrete to be finished with a surface which is very level and generally does not include the surface depressions which are formed when a conventional power trowel is utilized, would produce a highly polished surface finish with one pass of a power trowel or other finishing tool, and would, when a power trowel is utilized, greatly reduce the wear of the trowel blades and the maintenance required during operation of the trowel.

Therefore, it is a principal object of the invention to provide an improved method and apparatus for finishing freshly poured concrete.

Another object of the invention is to provide an improved method for finishing freshly poured concrete which substantially reduces the labor costs associated with finishing concrete and reduces the cost of constructing and operating a power trowel utilized in the finishing process.

A further object of the invention is to provide an improved method for finishing freshly poured concrete in which the utilization of fresnos is eliminated and in which concrete can be finished prior to the concrete hardening an amount sufficient to support the weight of an individual.

Another object of the instant invention is to provide a method for finishing the surface of freshly poured concrete which eliminates the formation of surface depressions of the type produced when conventional power trowels are utilized to surface concrete.

These and other, further and more specific objects and advantages of the invention will be apparent to those skilled in the art from the following detailed description thereof, taken in conjunction with the drawings, in which.

Briefly, in accordance with my invention, I provide a method for finishing poured concrete to produce a very smooth level suraface finish on the concrete. The method comprises the steps of screeding the concrete to preliminarily level the surface of the concrete; tamping the concrete to bring the fines to the surface; moving a bull float over the surface over the wet concrete, said bull float being fabricated from a material generally free of iron; and, passing a power trowel over the surface area of the concrete. The power trowel includes a frame; a plurality of spaced apart blades mounted on and radially extending from a rotating shaft; an engine mounted on the frame and operatively associated with and rotating the shaft; a handle having aproximate end and distal end, the handle being fixedly attached to the frame and extending outwardly away from the frame and generally horizontal to the surface of the concrete such that the distal end is positioned above an area of ground adjacent the concrete. The ratio of the weight in pounds of the trowel, exclusive of the handle, to the combined lower surface area of the blades is in the range of 1:4.8 to 1:25. The distal end of the handle is grasped by a user standing on the area of ground and, with minimal amounts of physical exertion by the user, is displaced in directions generally lying in a vertically plane passing through the handle to laterally displace the blades over the surface of the concrete. The concrete, when the pass is made with the power trowel, has not dried sufficiently to support the weight of an individual walking on the concrete, has a slump of two to five inches, and has a fluid-particulate surface over which the blades of the power trowel move with substantially less resistance than when the blades are moved over the surface of concrete which has dried sufficiently to support the weight of an individual.

Figure 1:
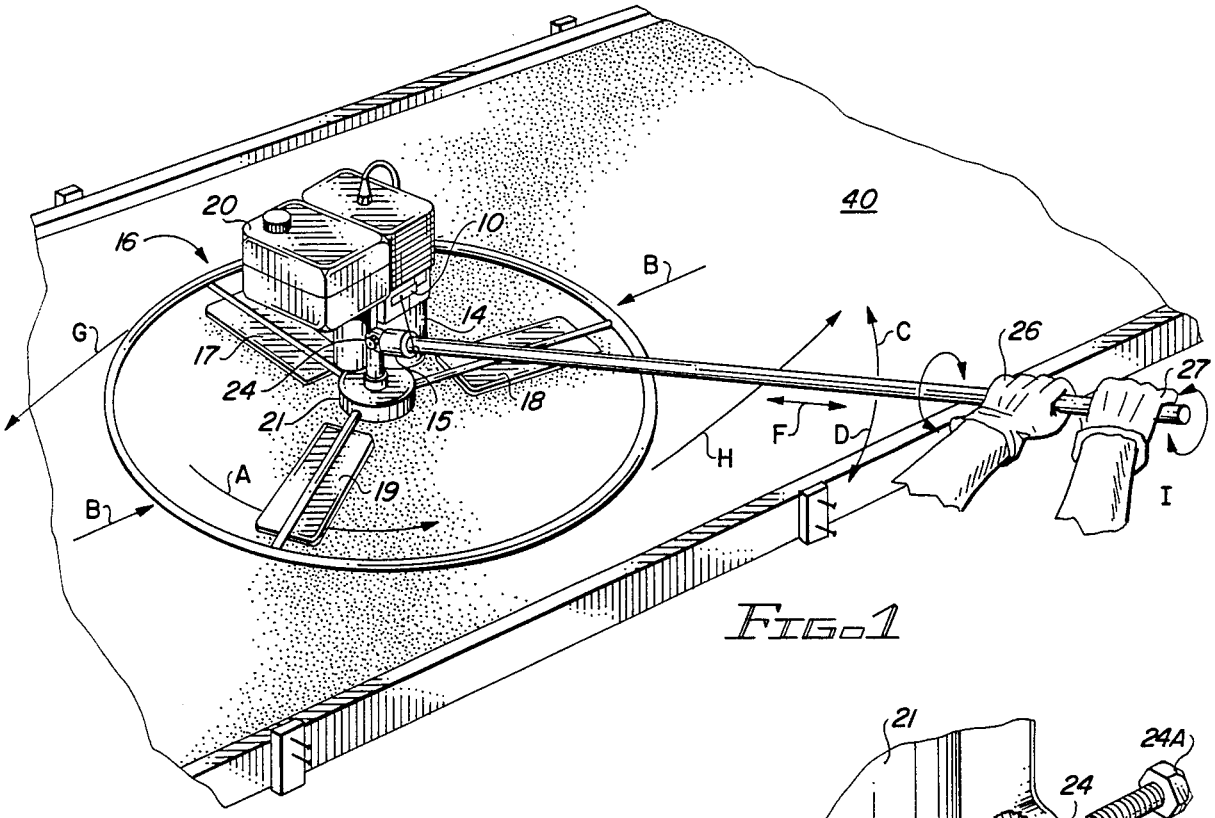
FIG. 1 is a perspective view illustrating utilization of a power trowel adapted in accordance with the principles of the invention.
Figure 2A:
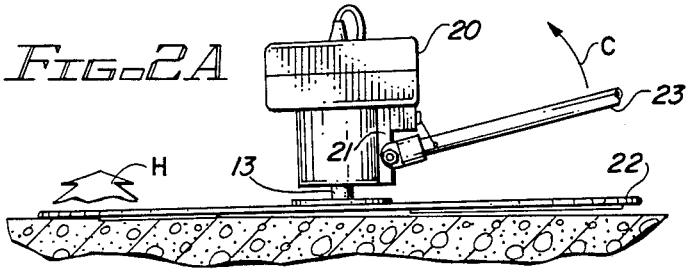
FIG. 2A is a side view illustrating the mode of operation of the invention.
Figure 2B:
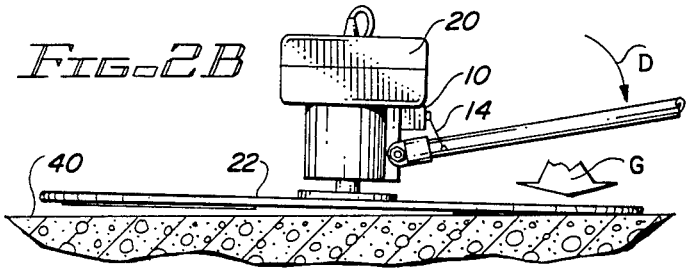
FIG. 2B is a side elevation view further illustrating the mode of operation of the invention.
Figure 3:
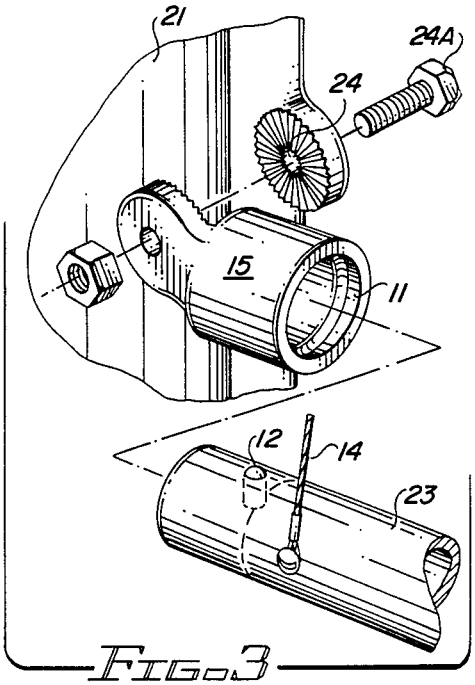
FIG. 3 is an exploded assembly view of a portion of the apparatus of FIG. 1 illustrating further construction details thereof.
Figure 5:
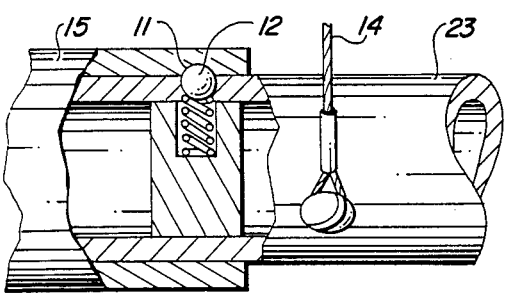

Turning now to the drawings, which depict the presently preferred embodiments of the invention for the purpose of illustrating the practice thereof and not by way of limitation of the scope of the invention and in which like reference characters represent corresponding elements throughout the several views, the presently preferred method of the invention includes the steps of pouring fresh concrete, screeding the surface of the concrete to preliminarily level the surface, tamping the concrete to bring the fines to the surface, bull floating the concrete to further smooth the surface, and power troweling the surface to form a final smooth, level finish on the surface of the concrete. In the method of the invention, after fresh concrete is bull floated, a fresno is not utilized. Instead, the surface of the concrete is immediately finished with a power trowel in the manner illustrated in FIG. 1. When power trowel 16 of the invention is utilized,the step of tamping the concrete 13 can be eliminated. when the power trowel is initially placed on the concrete, the slump of the concrete is in the range of two to five inches.

As shown in FIGS. 1 to 5, the power trowel 16 includes a plurality of substantially flat spaced apart blades 17–19 radially extending from a shaft 13 which is operatively associated with an engine 20 which rotates the shaft. Engine 20 is attached to vertical frame member 21. Circular guard rail 22 is attached to the outer tips of blades 17–19. Blades 17–19 and rail 22 rotate in the direction of arrows A. Engine 20 is a two cycle, 21 cc, one horsepower engine. Blades 17–19 rotate at 1 to 100 rotations per minute. The diameter, indicated by arrows B, of ring 22 is thirty four inches. Each rectangular blade is approximately five inches wide by twelve inches long, and accordingly, has a bottom surface area of sixty inches. Trowel 16, extending horizontal control rod 23, weighs less than fifty pounds, preferably twenty-five pounds. Rod 23 is hollow and the proximate end of rod 23 is rotatably mounted on a cylindrical sleeve 15 which slidably extends into the proximate end of rod 23. The cylindrical sleeve is attached to frame member 21 at point 24 with a bolt 24A such that the sleeve and, accordingly, rod 23, can, after the bolt 24A is loosened, be pivotally moved about point 24 up and down as indicated by arrows C and D. However, during use of trowel 16, the bolt at point 24 is tightened and the cylindrical sleeve and rod 23 cannot be pivotd up and down or laterally pivoted about point 24. When the bolt at point 24 is tightened, rod 23 can still be rotated in the cylindrical sleeve. Spring loaded ball bearing 12 rides in groove 11. A linkage interconnects rod 23 to the throttle 10 of the engine 20 such that the engine speed and rpm of the blades can be adjusted by manually rotating rod 23 in the cylindrical sleeve 15 in the directions indicated by arrows I. Rod 23 can comprise a plurality of elongate sections having ends whcih snap or thread together to form elongate linear rod 23.

Figure 4:
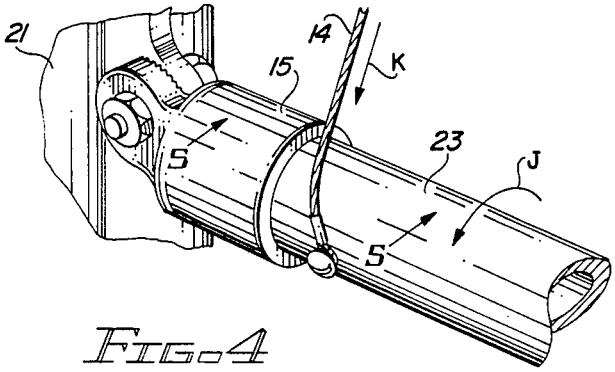
FIG. 4 is a perspective view of the apparatus of FIG. 3 illustrating the mode of operation thereof; and, FIG. 5 is a side view of the apparatus of FIG. 3 with a portion thereof broken away to illustrate interior construction details thereof.

In utilizing trowel 16, a user grasps the distal end of rod 23 with his hand(s) 26, 27 and gently pushes or pulls trowel 16 in the directions indicated by arrows F. The user can also readily manipulate rod 23 to move trowel 16 through an arc in the directions indicated by arrows G and H. Slightly upwardly displacing rod 23 in the direction of arrow C (FIG. 2A) causes ring 22 to move in th direction of arrow H. Slightly downwardly displacing rod 23 in the direction of arrow D (FIG. 2B) causes the ring 22 to move in the direction of arrow G. As earlier noted, rotating rod 23 in the directions indicated by arrows I adjusts the throttle of engine 20 to increase or decrease the speed of rotation of blades 17–19. In FIG. 4, rotating rod 23 in the direction of arrow J pulls cable linkage 14 in the direction of arrow K to increase the flow of gas to engine 20 and increase the speed of rotation of blades 17–19. An important advantage of the invention is that the afore-described adjustments of rod 23 which are used move ring 22 and blades 17–19 forward, backward, and laterally across cement 40 require a very small amount of physical effort and can be accomplished while the user stands in one spot of an area of ground adjacent the concrete. One reason that controlling the movement of trowel 16 requires a minimal amount of effort is that the trowel is utilized when the concrete is relatively wet. The blades of the trowel ride on a fluid-particulate mortar layer of the surface of concrete 40. This fluid-particulate lubricates the rotating blades 17–19 and offers minimal frictional resistance to blades 17–19. The forces generated by hand(s) 26 and 27 on rod 23 to move trowel blades 17–19 over the surface of concrete 40 are all generally produced in a vertical plane passing through rod 23.

Pushing and pulling the rod 23 in the directions indicated by arrows F occurs in this vertical plane, and raising and lowering rod 23 in the directions of arrows C andD occurs in the vertical plane.

In the power trowel presently utilized in the practice of the invention, the ratio of the weight in pounds of the trowel, exclusive of control rod 23, to the combined surface area of blades 17–19, in square inches, is 1:9.6. This ratio is preferably in the range of 1:4.8 to 1:25. The control rod weight is minimal, typically two pounds per six foot length of rod 23. The weight to blade surface areas ratio found inconventional power trowels are typically 1:3.4 to 1:4.2. such ratios are not acceptable in the practice of the invention because the greater weight of conventional power trowels increases the force of blades 17–19 against the surface of concrete 40 and tends to force the blades through the fluid-particulate float layer on the surface of the concrete to a lower concrete layer which offers substantially great resistance to the rotation of the blades. In fact, if a conventional power trowel is placed on concrete 40 after bull floating is complete,the trowel will sink into the concrete.

The conventional T-handle found on prior art power trowels is not acceptable in the practice of the invention because such a handle can not be utilized to simultaneously control movement of the trowel over concrete 40 and to accurately adjust the throttle on engine 20 by rotating rod 23 in the directions of arrows I. Elongate rod 23 should be tubular and be able to transmit rotational movements generated on the distal end of rod 23 by hand(s) 26, 27 to the proximate end of rod 23 adjacent engine 20.

When a power trowel having the proper weight and rpm parameters is moved across the surface of the concrete 40 with a generally horizontally disposed control rod 23, the time and physical effort required to produce an extremely smooth flat surface on the concrete are minimal.

Having described my invention in such terms as to enable those skilled in the art to understand and practice it and having identified the presently preferred embodiments and best mode thereof, I claim:

1. A method for finishing poured concrete to produce a smooth level surface finish on the concrete, said method comprising the steps of (a) screeding a surface of the poured concrete to preliminarily level the surface of the concrete;

(b) then moving a bull float over said surface said bull float being fabricated from a material generally free of iron;

(c) and then making a pass over said surface with a power trowel, said trowel including (i) a frame, (ii) a plurality of spaced apart blades mounted on and radially extending from a rotating shaft, each of said blades having a lower surface area;

(iii) an engine mounted on said frame and operatively associated with and rotating said shaft;

(iv) a handle having a proximate end and distal end, said handle being fixedly attached to said frame and extending horizontally outwardly away from said frame over the surface of said concrete such that said distal end is positiond above an area of ground adjacent said concrete;

the ratio of the weight in pounds of said power trowel, exclusive of said handle to the combined lower surface area of said blades being in the range of 1:4.8 to 1:25;

said distal end of said handle being grasped by a user standing on said area of ground and, with minimal amounts of physical exertion by said user, being displaced in directions generally lying in a vertical plane pasing through said handle to laterally displace said blades over said surface of said concrete; and, said concrete, when said power trowel is initially placed thereon, not having dried sufficiently to support the weight of an individual walking on the concrete, having a fluid particulate surface over which said blades of said power trowel move with substantially less resistance than when said blades are moved over a surface of concrete which has dried sufficiently to suuport the weight of an individual, and, having a slump of two to five inches.

2. The method of claim 1 wherein (a) said handle is substantially rigid along its length such that rotation of said diatal end causes said proximate end to rotate; and, (b) said proximate end of said handle is operatively associated with a throttle of said engine such that rotation of said proximate end alters the speed of rotation of said blades.

3. The method of claim 2 wherein said handle comprises an elongate rod.

* * * * *